United States Patent [19]

Spiegel et al.

[11] Patent Number: 4,991,832

[45] Date of Patent: Feb. 12, 1991

[54] DELIVERY SHEET BRAKE FOR A SHEET-FED PRINTING PRESS

[75] Inventors: Nikolaus Spiegel, Walldorf; Karl-Heinz Filsinger, Wiesloch; Roland Hirth, Römerberg, all of Fed. Rep. of Germany

[73] Assignee: Heidelberger Druckmaschinen AG, Heidelberg, Fed. Rep. of Germany

[21] Appl. No.: 426,962

[22] Filed: Oct. 25, 1989

[30] Foreign Application Priority Data

Oct. 25, 1988 [DE] Fed. Rep. of Germany ..... 3836253

[51] Int. Cl.[5] ..... B65H 29/68

[52] U.S. Cl. ..... 271/183; 271/103

[58] Field of Search ..... 271/183, 204, 103

[56] References Cited

U.S. PATENT DOCUMENTS

| | | | |
|---|---|---|---|
| Re. 25,283 | 11/1962 | Ying Ling | 271/183 |
| 2,208,978 | 7/1940 | Harrold et al. . | |
| 3,378,256 | 4/1968 | Ellis | 271/183 |
| 3,702,698 | 11/1972 | Schwebel | 271/103 |

FOREIGN PATENT DOCUMENTS

| | | |
|---|---|---|
| 2915718 | 3/1980 | Fed. Rep. of Germany . |
| 322681 | 5/1983 | Fed. Rep. of Germany . |
| 1456399 | 11/1976 | United Kingdom . |

*Primary Examiner*—Richard A. Schacher

*Attorney, Agent, or Firm*—Herbert L. Lerner; Laurence A. Greenberg

[57] ABSTRACT

A delivery sheet brake for sheet-fed printing presses having a sucker formed with a suction opening movable on a closed loop path at varying speed corresponding in a sheet-transfer position to travel speed of a sheet and then being deceleratable until a sheet-release position is reached above a pile of sheets at a delivery, elements of a drive connected to the sucker for imparting a horizontal motion component to the sucker which is simultaneously movable vertically, and control valves for controlling vacuum in a suction line connected to the sucker, the sucker including a piston disposed in a cylinder of a housing so as to be movable in direction of a longitudinal axis of the piston, the housing being connected to the drive and being disposed swivelingly on a shaft having an axis extending transversely to a direction of travel of the sheet and parallel to the sheet, the piston being reciprocatingly movable in the cylinder of the housing by the vacuum in the suction line to the sucker and being controllable by contact of the sheet with the suction opening.

6 Claims, 3 Drawing Sheets

DELIVERY SHEET BRAKE FOR A SHEET-FED PRINTING PRESS

The invention relates to a delivery sheet brake for a sheet-fed printing press, the delivery sheet brake having a sucker formed with a suction opening movable on a closed loop path at varying speed corresponding in a sheet-transfer position to travel speed of a sheet and then being deceleratable until a sheet-release position is reached above a pile of sheets at a delivery, elements of a drive connected to the sucker for imparting a horizontal motion component to the sucker which is simultaneously movable vertically, and control valves for controlling vacuum in a suction line connected to the sucker.

These generic features have become known heretofore from German Published Non-Prosecuted Application (DE-OS) No. 16 36 316. The sucker which grips the oncoming sheet in the delivery by the trailing edge thereof is supported on a lever guide, one lever of which is connected to an eccentric of a uniformly revolving first drive element, which effects lifting and lowering movements i.e. reciprocations, of the sucker, and the other lever of which is coupled to a second drive element which causes horizontal movements of the sucker. This second drive element is formed of a cam disc against which a roller is held which is mounted on a toothed segment meshing or engaging in a gearwheel mounted with the lever on the same shaft. Such a drive for the delivery sheet brake permits the sucker to be lifted by the one drive element against the trailing edge of the sheet, which enters the delivery more-or-less horizontally and, simultaneously, the horizontal motion of the sucker to be accelerated by the other drive element to more-or-less sheet speed in as short a distance as possible from a starting position. After transfer of the sheet to the sucker in the transfer position, which coincides in time with the release of the sheet by the transport means of the delivery or which slightly overlaps with the latter, the sucker is lowered against the delivery pile by the first-mentioned drive element and is simultaneously decelerated in as long a distance as possible by the other drive element before the sucker releases the sheet in the release position and returns at relatively high speed to the starting position, both drive elements being mutually cooperative. Both drive elements are connected via gearwheels and drive chains to the drive of the conveying chain of the delivery. Such a drive for the sucker is very costly and demands precise coordination of both drive elements when the press is being set up. Because the drive means for the sucker are form-lockingly i.e. positively, connected to the latter and, consequently, are disposed on the slide for possible format adjustment, it is necessary each time to adjust the delivery sheet brake in the event of a change in format of the sheets to be printed. This is time-consuming and, in the case of incorrect adjustments, leads to smearing and inaccurate running or travel of the paper, particularly at high printing speeds.

U.S. Pat. No. 2,130,841 also discloses a delivery sheet brake in which the vertical and the horizontal motions of a sucker are achieved by separate drive means and correspondingly costly transmission elements. This publication does not take into consideration any of the problems caused by changes in the format of the sheets that are to be printed.

It is accordingly an object of the invention to provide a delivery sheet brake of the aforementioned general type in which the sucker, while maintaining a high level of operational reliability at high press speeds, merely requires drive means for a swivelling motion about a transverse axis.

With the foregoing and other objects in view, there is provided, in accordance with the invention, a delivery sheet brake for sheet-fed printing presses having a sucker formed with a suction opening movable on a closed loop path at varying speed corresponding in a sheet-transfer position to travel speed of a sheet and then being deceleratable until a sheet-release position is reached above a pile of sheets at a delivery, elements of a drive connected to the sucker for imparting a horizontal motion component to the sucker which is simultaneously movable vertically, and control valves for controlling vacuum in a suction line connected to the sucker, the sucker comprising a piston disposed in a cylinder of a housing so as to be movable in direction of a longitudinal axis of the piston, the housing being connected to the drive and being disposed swivelingly on a shaft having an axis extending transversely to a direction of travel of the sheet and parallel to the sheet, the piston being reciprocatingly movable in the cylinder of the housing by the vacuum in the suction line to the sucker and being controllable by contact of the sheet with the suction opening.

A sucker having these features automatically performs the lifting and lowering movements under the effect of the vacuum necessary for the operation of the sucker and atmospheric pressure so that, in order to obtain a horizontal motion component, it is necessary merely to effect a swivelling motion of the sucker about a transverse axis parallel to the plane of the sheet. The drive means for this reciprocating swivelling motion may thereby be of considerably simpler construction when compared with heretofore known constructions. These relatively simpler drive means, moreover, permit the drive for the swivelling motions of the sucker to be effected directly from the printing press, as is explained hereinafter with reference to an illustrative embodiment. By appropriate construction of the sucker piston and of the housing accommodating it, assurance is afforded that the sucker is retractable into the lowered position by vacuum forces or by the external atmospheric pressure and that it is extensible into a lifted position likewise as a result of vacuum forces. The instant the sheet closes the suction opening of the sucker, the vacuum forces retracting the sucker predominate, with the result that the sucker is lowered. The sucker is drawn down by the piston the instant the sucker has reached the sheet in the transfer position, so that the suction opening no longer moves on a circular path but on a slightly longer elliptical path until it reaches the release position. This aids efforts to decelerate the sheet over as long a distance as possible before it is deposited on the pile in the delivery. Over this deceleration distance, the sucker changes its angular position with respect to the plane of the sheet and, in order thereby to prevent the detachment of the sheet from the suction opening, in accordance with another feature of the invention, the sucker includes an elastically deformable bellows wherein the suction opening is formed.

In accordance with an added feature of the invention, the piston has piston surfaces of different size at opposite end faces thereof and is formed with a channel connecting two cylinder spaces at the two ends of the piston to one another, the channel being formed as a throttle.

In accordance with a further feature of the invention, the piston is formed with a through-bore extending in direction of the longitudinal axis thereof, and one of the cylinder spaces is located in front of a larger end face thereof and is connected to the suction line.

In accordance with another feature of the invention, the housing is disposed on a hollow shaft which forms the suction line and is swivel-mounted at the ends thereof, the housing being formed with a channel connecting the interior of the hollow shaft to the other of the cylinder spaces, the other cylinder space having an annular shape.

In accordance with a concomitant feature of the invention, the housing is swivel-mounted on an adjustable slide of a format-adjusting device and is connected to a drive element driven directly by the drive of the printing press.

Other features which are considered as characteristic for the invention are set forth in the appended claims.

Although the invention is illustrated and described herein as embodied in a delivery sheet brake for a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
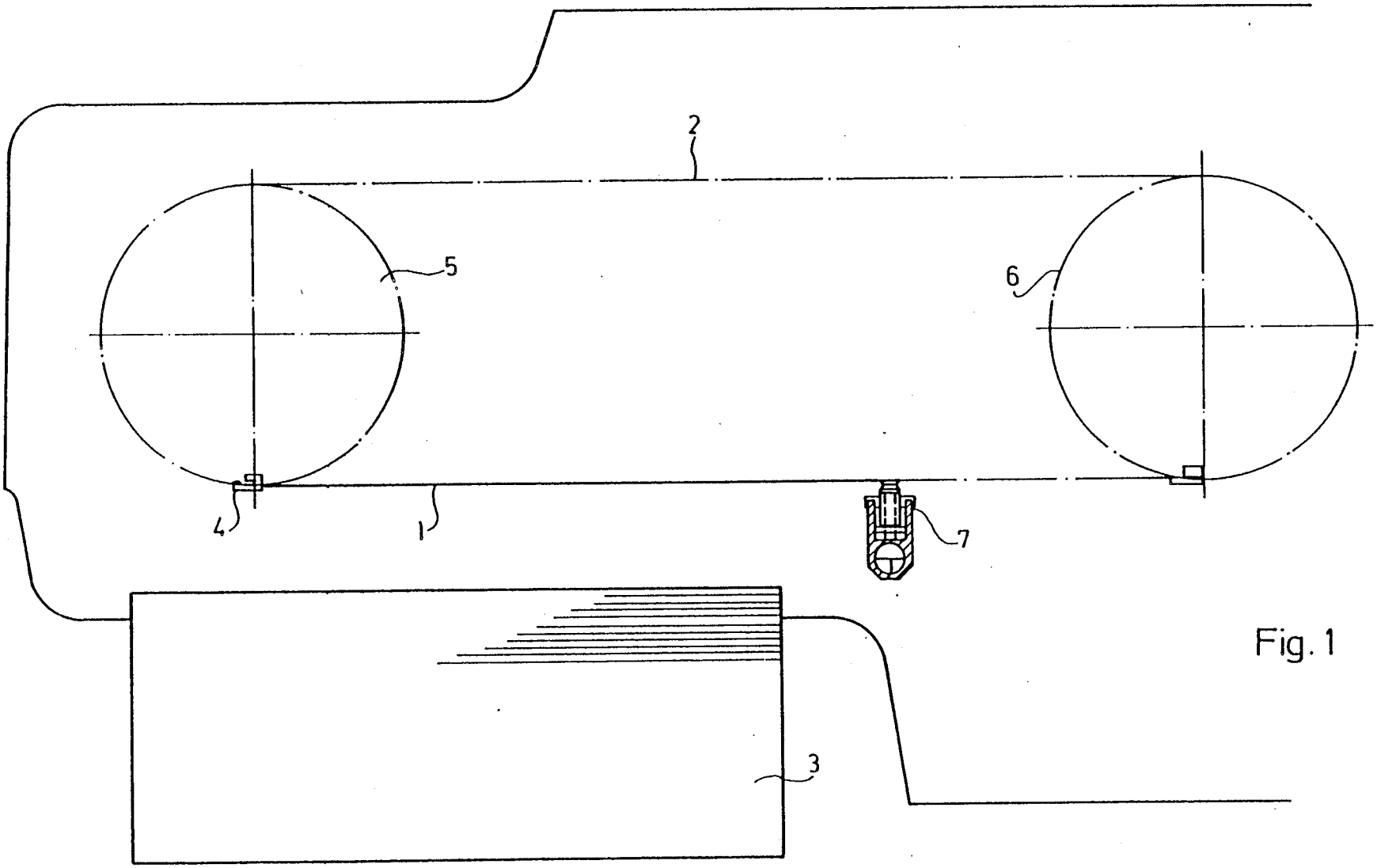
FIG. 1 is a diagrammatic side elevational view of a sheet delivery with a delivery sheet brake formed with a sucker.

Referring now to the drawing and first particularly to FIG. 1 thereof, there is shown therein a sheet 1 arriving from a printing press which is transported over a delivery pile 3 by a conveying chain 2, the sheet 1 being gripped at a leading edge thereof by grippers 4 on the conveying chain 2, the latter being guided by deflectors in the form of reversing rollers 5 and 6. The sheet 1 is guided somewhat horizontally to the delivery. At the end of this movement, a sucker 7 engages the trailing edge of the sheet 1 which, simultaneously or with a slight overlap in time, is released by the grippers 4 of the conveying chain 2, so that the sheet 1 is lowered to the sheet pile 3 and, accordingly, decelerated by the motion of the sucker 7 and finally deposited gently onto the pile of sheets 3. This deceleration of the sheet is intended to take place over as long a path as possible so that the sucker has to be accelerated from a starting position thereof up to the speed of the sheet in as short a distance as possible, so that it can take the sheet over without any difference in speed relative to the sheet and so that it returns at low speed to the starting position when it has released the sheet for deposit upon the delivery pile. This movement is achieved by a drive element formed of a cam disc 8, which is mounted in a slide 9 so as to be rotatable about a horizontal shaft, the slide 9 bearing all the parts for format adjustment and its horizontal adjustment capability being illustrated by the circles symbolically indicated on the underside of the slide 9. Also disposed on the slide 9 is the sucker 7, which is swivelingly movable about another shaft 11 disposed so that its axis is parallel to the rotational axis 10. A roller 12 is pressed by spring force e.g. by a tension spring 36, against the circumference of the cam disc 8, the roller 12 being mounted at the free end of a short lever 13 of a four-link drive formed of a plurality of levers, the drive forming a step-up transmission. Another lever 14 is rigidly connected to the shaft 11. Its free end is connected in a joint 17*a* to one end of a lever 15, the other end of which is connected in a joint 17*b* to a lever 16, which has a rigid connection to the lever 13 bracing the mounting of the roller 12. The levers 13 and 16 may also be of one-piece or integral construction. The two levers 13 and 16 have a common joint 17*c*, which is disposed on the slide 9. The lever 14 is also disposed with its joint 17*d* on the slide 9 via the shaft 11. By suitable coordination of the lever lengths, it is possible to achieve wide ranges of transmission ratios by relatively simple means.

Rigidly connected to the cam disc 8 is a chain wheel 18 which is driven by a drive chain 19 directly from a chain wheel 20 of the printing-press drive. The drive chain 19 passes through a chain-storage device 21, which holds both chain stringers or runs 19*a* and 19*b* under uniform tension. Thus, the chain wheel 18 on the cam disc 8 can be adjusted at a distance from the chain wheel 20, while the phase position between the two chain wheels 18 and 20 is maintained, however. This permits format adjustments and changes in speed of the printing press without influencing the adjusted position and movement of the sucker 7 of the delivery sheet brake.

In the embodiment of the chain-storage device 21 shown in the drawing, both chain stringers 19*a* and 19*b* are guided over a plurality of deflection rollers 22 and 23, with the chain stringers 19*a* and 19*b*, respectively, alternately winding partly around the rollers 22 and 23 respectively assigned thereto. The rollers 22 supporting the one chain stringer 19*a* are mounted on a common carrier 24, and the rollers 23 supporting the other chain stringer 19*b* are mounted on a common carrier 25, the two carriers 24 and 25 being forced apart by helical springs 26 and 27. A parallel guide formed of at least one cross-scissors unit 33 with two straps articulatingly connected to one another at a center 34 thereof, the one ends of which are articulatingly connected to the one carrier 24, and the opposite ends of which to the other carrier 25, maintains the carriers 24 and 25 parallel to one another. The two helical springs 26 and 27 disposed at the ends of the carriers 24 and 25 force the carriers 24 and 25 apart and thus effect a constantly uniform tensioning of the conveying chain 19 and compensate for changes in the spacing between the two chain wheels 18 and 20 without phase displacement.

Figures 2, 3:
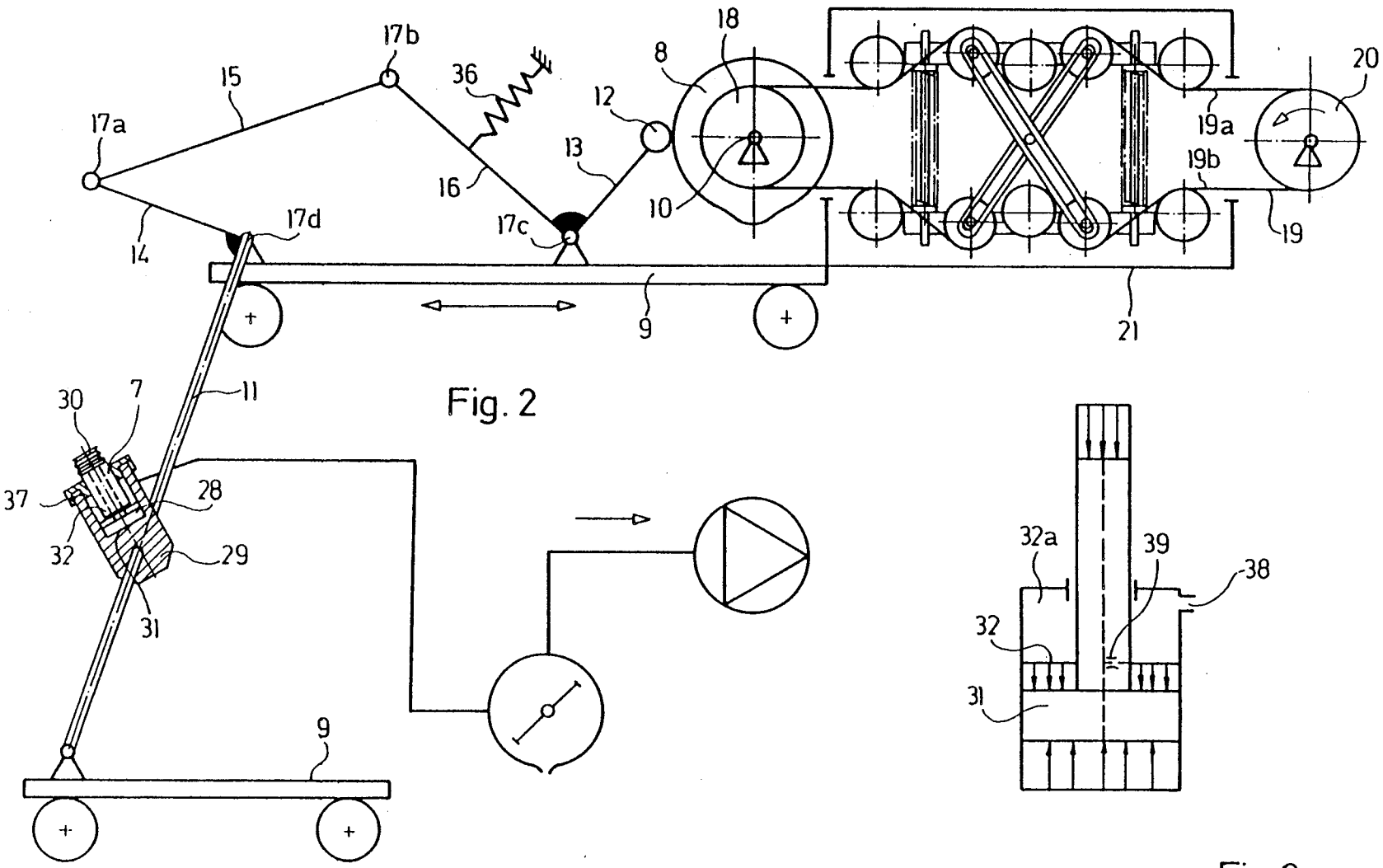
FIG. 2 is a diagrammatic view of a drive for the sucker of the delivery sheet brake.
FIG. 3 is a diagrammatic view of the sucker explaining the operating principle thereof.

At one end, the body of the sucker 7 is in the form of a piston 28 and is guided with this piston in a cylinder of a housing 29 so as to be movable in the direction of the longitudinal axis of the piston 28. The housing 29 is mounted on the shaft 11 which, in the illustrated embodiment of FIG. 2, is formed as a hollow shaft. The suction opening of the sucker 7 is formed in an elastically deformable folded bellows 30, which is located at the free outer end of the sucker 7. The piston bearing the sucker has an end face 31 at an end thereof facing away from the bellows 30 and an annular surface 32 at the other end thereof, the annular surface 32 extending around the body of the sucker 7 in a likewise annular cylinder space 32*a* inside the housing 29. This cylinder space 32*a* is connected by a lateral connection port 38 via the hollow shaft 11 to the non-illustrated suction-air system of the printing press. Furthermore, the cylinder spaces located in front of the end face 31 and the annular surface 32 are connected to one another by a channel 39 serving as a throttle. Under atmospheric pressure, the sucker 7 drops into the lower position because of its own weight or because of the force of a spring 37 provided in the cylinder space 32*a* and with the assistance of the force of a spring, respectively. The instant vacuum takes effect in the sucker, in the working cycle of the printing press, however, the sucker extends out of the housing because of the then resulting pressure difference. With the opening of the suction opening, atmospheric pressure acts upon the end face 31 and vacuum acts upon the annular surface 32. Upon transfer of the sheet 1, the latter closes the suction opening so that vacuum then acts upon the end face 31 of the piston 28 and also upon the cross section of the body of the sucker, and the latter is retracted into the housing 29 due to the pressure difference then acting in the opposite direction to the aforementioned pressure difference. At the instant at which the sheet is released, a rotary valve 35 interrupts the vacuum connection of the sucker, so that the piston, under the action of atmospheric pressure and of the spring 37, remains in the retracted position, and the sucker swivels back in this retracted condition into the starting position.

Figure 4A:
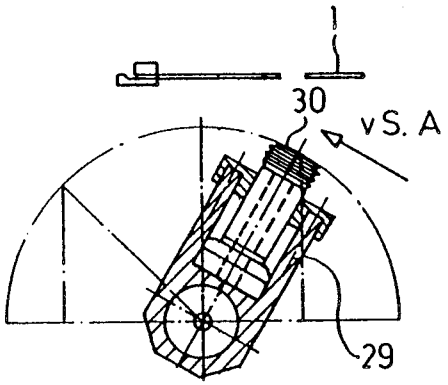
FIGS. 4*a* to 4*f* are enlarged longitudinal sectional views of the sucker of the delivery sheet brake shown in FIGS. 1 and 2 in various phases of motion thereof.
Figure 4B:
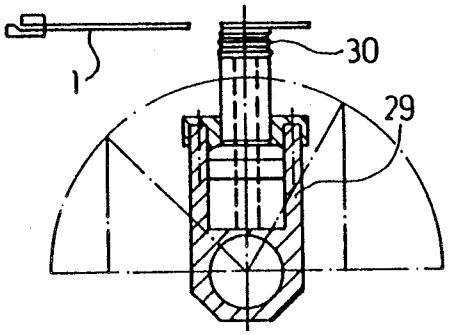
Figure 4C:
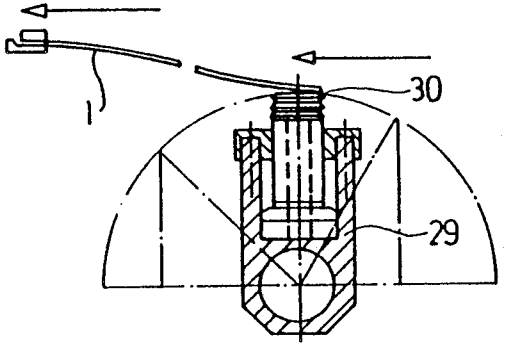
Figure 4D:
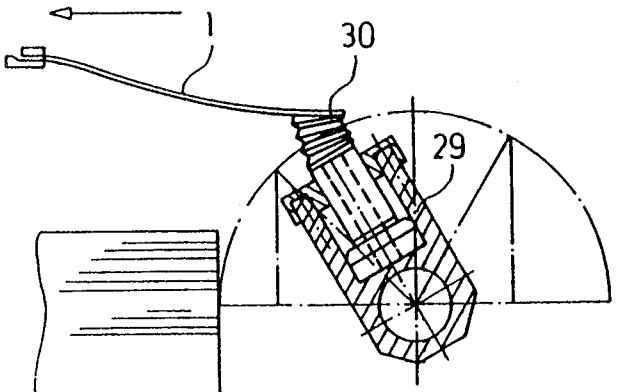
Figure 4E:
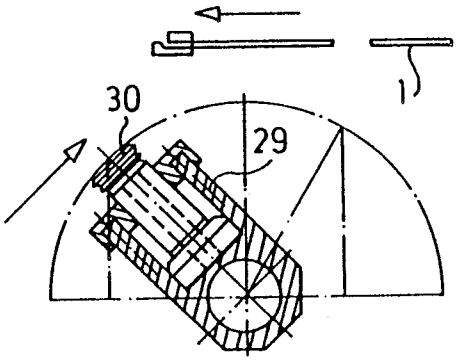
Figure 4F:
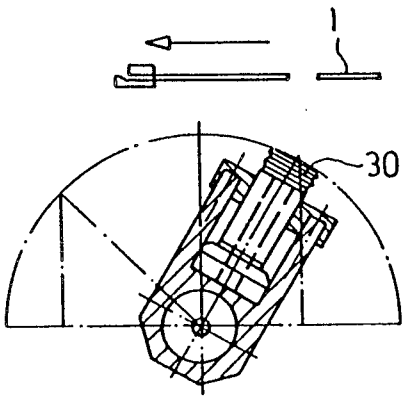

FIGS. 4*a* to 4*f* compare the phases of movement of the sucker and the position of the piston in the individual phases of movement. In FIG. 4*a*, the sucker 7 is accelerated out of the staring position A from zero to sheet speed. In this connection, the sucker is moved out of the housing 29 by the vacuum and by the resulting pressure difference, possibly with assistance from centrifugal forces, so that, in the transfer position shown in FIG. 4*b*, it grips the trailing edge of the sheet 1 in the raised position. With the suction opening closed, the vacuum acts also on the end face 31 as well as on the cross section of the shaft-shaped body of the sucker, with the result that the sucker is retracted into the lower position by the then resulting pressure difference, which acts in the opposite direction, with the sucker 7 being simultaneously decelerated on its swivelling path as represented in the view of FIG. 4*d*. FIG. 4*d* shows the position of the sucker immediately prior to the release of the sheet 1. FIG. 4*e* represents the start of the return of the sucker to the starting position, while FIG. 4*f* is identical with FIG. 4*a*. From the view of FIG. 4*a* to 4*f*, it is apparent that the suction opening of the sucker 7 moves on a loop-shaped path, the horizontal extent of which is considerably greater than the vertical extent. The suction-gripping of the sheet and the release thereof may be effected in a conventional manner, for example by the rotary valve 35 driven by the printing press and located in a vacuum line between the sucker 7 and a vacuum pump 36.

For reasons of clarity, the foregoing description refers to only one sucker; it is also possible, however, when practising the invention, to provide a plurality of suckers in a printing press.

The foregoing is a description corresponding in substance to German Application No. P 38 36 253.8, dated Oct. 25, 1988, the International priority of which is being claimed for the instant application, and which is hereby made part of this application. Any material discrepancies between the foregoing specification and the aforementioned corresponding German application are to be resolved in favor of the latter.

We claim:

1. Delivery sheet brake for sheet-fed printing presses having a sucker formed with a suction opening movable on a closed loop path at varying speed corresponding in a sheet-transfer position to travel speed of a sheet and then being deceleratable until a sheet-release position is reached above a pile of sheets at a delivery, elements of a drive connected to the sucker for imparting a horizontal motion component to the sucker which is simultaneously movable vertically, and control valves for controlling vacuum in a suction line connected to the sucker, the sucker comprising a piston disposed in a cylinder of a housing so as to be movable in direction of a longitudinal axis of the piston, said housing being connected to the drive and being disposed swivelingly on a shaft having an axis extending transversely to a direction of travel of the sheet and parallel to the sheet, said piston being reciprocatingly movable in the cylinder of the housing by the vacuum in the suction line to the sucker and being controllable by contact of the sheet with the suction opening.

2. Delivery sheet brake according to claim 1, wherein the sucker includes an elastically deformable bellows wherein the suction opening is formed.

3. Delivery sheet brake according to claim 1, wherein said piston has piston surfaces of different size at opposite end faces thereof and is formed with a channel connecting two cylinder spaces at the two ends of the piston to one another, said channel being formed as a throttle.

4. Delivery sheet brake according to claim 3, wherein said piston is formed with a through-bore extending in direction of the longitudinal axis thereof, and one of said cylinder spaces is located in front of a larger end face thereof and is connected to the suction line.

5. Delivery sheet brake according to claim 4, wherein said housing is disposed on a hollow shaft which forms said suction line and is swivel-mounted at the ends thereof, said housing being formed with a channel connecting the interior of the hollow shaft to the other of said cylinder spaces, said other cylinder space having an annular shape.

6. Delivery sheet brake according to claim 1, wherein said housing is swivel-mounted on an adjustable slide of a format-adjusting device and is connected to a drive element driven directly by the drive of the printing press.

* * * * *